US007356932B1

(12) United States Patent
Nguyen et al.

(10) Patent No.: US 7,356,932 B1
(45) Date of Patent: Apr. 15, 2008

(54) CARPET TRIMMER

(75) Inventors: Tan D. Nguyen, Milpitas, CA (US); Lance D. Crain, Fremont, CA (US)

(73) Assignee: Crain Cutter Company, Inc., Milpitas, CA (US)

( * ) Notice: Subject to any disclaimer, the term of this patent is extended or adjusted under 35 U.S.C. 154(b) by 300 days.

(21) Appl. No.: 11/106,419

(22) Filed: Apr. 14, 2005

Related U.S. Application Data

(60) Provisional application No. 60/612,359, filed on Sep. 23, 2004.

(51) Int. Cl.
*B26B 5/00* (2006.01)
*B26B 29/00* (2006.01)

(52) U.S. Cl. ..... 30/287; 30/293; 30/294

(58) Field of Classification Search ..... 30/286, 30/287, 289, 293, 294; 116/234, 280, 327
See application file for complete search history.

(56) References Cited

U.S. PATENT DOCUMENTS 619,397 A * 2/1899 De Costa ..... 30/293
2,772,474 A * 12/1956 Hill et al. ..... 30/293
3,363,314 A 1/1968 O'Brien ..... 30/125
3,382,579 A 5/1968 Prater ..... 30/329
3,395,453 A 8/1968 Prater ..... 30/293
3,535,786 A 10/1970 Sanders ..... 30/293
3,581,397 A 6/1971 Kochanowski ..... 30/293
3,605,267 A 9/1971 Brenner ..... 30/287
3,934,341 A * 1/1976 Carlson ..... 30/287
4,095,341 A * 6/1978 Crain ..... 30/287
4,262,418 A * 4/1981 Hill et al. ..... 30/287
5,996,237 A * 12/1999 Sanders ..... 33/42
6,230,410 B1 * 5/2001 Taylor et al. ..... 30/293
6,421,923 B1 * 7/2002 Nguyen ..... 30/287

* cited by examiner

*Primary Examiner*—Boyer D. Ashley
*Assistant Examiner*—Edward Landrum
(74) *Attorney, Agent, or Firm*—Schneck & Schneck; David M. Schneck

(57) ABSTRACT

A carpet trimmer including a base, a pair of posts mounted on said base and a handle mounted on said base. A number of spacers are inserted over the posts and secured by fasteners. A blade holder holding a pair of blades and including a blade holding face and a wall runner is inserted between two of the spacers, such that the posts fit into groove on the blade holding face. Throat adjustment holes on said spacers receive dimples on the blade holder to allow throat adjustment.

9 Claims, 6 Drawing Sheets

CARPET TRIMMER

CROSS-REFERENCE TO RELATED APPLICATION

This application claims priority from provisional application Ser. No. 60/612,359 filed Sep. 23, 2004.

TECHNICAL FIELD

The present invention relates to tools for the installation of carpets and more particularly to a carpet trimmer.

BACKGROUND OF THE INVENTION

When installing carpets, a carpet trimming tool is used to trim excess carpet from the edge of a section of carpet. This edge is trimmed at a location of the carpet along the wall of a room. Typically the excess carpet along the wall is folded up the wall when the carpet is just about to be trimmed. Ideally the carpet trimming tool can make a precision cut to trim close to a wall, while also cutting the carpet slightly larger than the room such that an edge of the carpet may be tucked into a narrow gap between the tack strip and the wall. As the slight excess of carpet that is desired for tucking is located at a point which is lapped up the wall, the carpet trimming tool requires its blades to be held at an elevation slightly higher than the face of the carpet. Such a tool may move along the edge of the room cutting a length of carpet slightly longer than the edge of the room. In addition the tool should have blades that can be adjusted to accommodate both the type of carpet and the features of the room.

A typical carpet trimming tool includes a base, a handle mounted on the base, a blade holder, and a means for adjusting the tool. Typically such carpet trimming tools may be adjusted in two dimensions. The blade holder may be adjusted such that the blades are at varying heights with relation to the base. This adjusts the amount of carpet which is trimmed allowing more or less carpet to be left to tuck between the gap between a tack strip and a wall. Secondly, the spacing between the outer edge of the base of the trimmer and a guide which contacts the wall (called a wall runner), which defines the carpet entry space or "throat" must be adjustable for various thicknesses of carpet.

All references in this section are hereby expressly incorporated by reference herein.

One prior art carpet trimmer is illustrated in U.S. Pat. No. 2,772,474 (the '474 device). This reference discloses a carpet trimmer including a substantially flat base on which two posts are mounted. A stack of spacers may be secured over the posts. A blade holder is inserted between two spacers. The blade holder is typically an "L" shaped metal part, having a first long surface which acts as the blade holding surface. The blade holder is designed to be mounted between spacers. A second, shorter surface is formed by a downward bend and contacts the wall to guide the trimmer (hereinafter the "wall runner"). The blade holder surface has a set of parallel slots. The posts on the base run through these slots as the user inserts the blade holder into the shim deck. The posts on the base may retain the slots as a user slides the blade holder past the post. Once the blade holder is inserted between two spacers, a fastener (such as a bolt) may be tightened down on top of the spacer stack, frictionally holding the blade holder at a selected height. The more spacers underneath the blade holder, the more the trimmer will leave of the carpet edge that is folded up against a wall. This allows more carpet that will remain uncut and available for tucking.

Depending upon the type of carpet and the space of the gap between the tack strip and the wall, different amounts of excess carpet are desirable. For this reason, an exact adjustment in height is necessary for a carpet trimming tool. This reference also discloses a means to adjust the throat width. The throat adjustment is necessary in the area where the carpet enters the trimmer. For thick plush carpets, the throat width of the tool must be adjusted such that there is sufficient width to accommodate the thickness of the carpet. In the above-cited reference, a locating plate is used in conjunction with the blade holder to provide a means for throat adjustment. The locating plate includes a number of holes on side edges of the locating plate and a spacer retaining dimples at a back edge of the plate. On the blade holder a pair of side dimples fit into the holes on the locating plate. The plurality of holes spaced along the sides of the locating plate allow adjustment of throat width. On the locating plate are slots, similar to those on the blade holder, which engage the posts mounted on the base. Altering which holes on the locating plate the dimples are secured into changes the width of the blade holder face (wall runner face) from the locating plate. When the two devices are inserted onto the post, the width of the throat is thus changed.

The blades on this device are mounted on the bottom side of the blade holder. A pair of spring clips holds the blades against this bottom side surface. The front end of the blade is held in place by a raised lip formed within the inside surface of the wall runner. The back end of the blade is held in place a raised lip. The locating plate is shaped such that the spring clips are accommodated within a gap on the locating plate.

There are a few drawbacks to the design of this tool. When changing the blades, the location of blade insertion on the bottom side of the blade holder creates many problems. When the blade holder is removed from the shim deck, the user must flip the blade holder upside down to even view the blades, which is awkward from a visual standpoint. The use of biased springs to hold the blades against the underside of the blade holder requires significant force in order to remove the blades. Without great caution, the user is likely to cut his finger. After many blade changes, the biased springs tend to lose their shape and become less effective at holding the blade.

Whenever height adjustment is required, the two-piece combination of blade holder and locating plate is difficult to insert between two shims. The user has to separate the shims with one hand, and insert the blade holder and locating plate with the other hand. Often the dimples on the blade holder slip out of the holes in the locating plate. The shims prevent the user from seeing the relationship of the holes and the dimples. For these reasons, misalignment is a common problem and further adjustment is often required.

To address some of the weakness of this '474 device, new devices have been designed. One is disclosed in U.S. Pat. No. 4,095,341 assigned to Crain Cutter Company, Inc. This device includes a blade holder designed to sit on top of a deck of shims. If a user requires a different height adjustment of the blade holder, one or more shims is removed. Thus, inserting the blade holder between the shims is not necessary.

As with the '474 device, the tool includes a base and a pair of posts mounted on the base. However, to enable a different means of throat adjustment, the base of the device has two parts, a handle retaining plate including two slots, and a false bottom plate onto which the posts are mounted. The handle holding plate has two dimples next to the slots. The false bottom plate has two posts extending from it which may be inserted through the two slots on the handle retaining plate. The false bottom plate also includes several holes adjacent to the posts. These holes may be fitted into the dimples. This configuration allows adjustment of the posts in relation to the front edge of the base, and in turn, moves the entire shim deck and blade holder, which in turn provides the means for throat adjustment. Unlike the '474 device, this means of throat adjustment is a highly visual process. When viewed from the base of the trimmer, the entire process is plainly visible.

Because the blade holder is always positioned on the top of the tool the user has a simplified means of changing the blades. A nut or fastener may be removed from the top of the posts and a blade-retaining bracket removed from on top of the blade. In this way, the blade may be removed from a surface on top of the trimmer, not beneath the shims and blade holder. No biasing spring is required because a bracket secures the blade in place in a blade recess area. This greatly reduces the chances of the user cutting their hand during blade change. This also provides the quickest way of changing the blade given that the height adjustment is not again required after the blade has been changed. In addition, the top mounting allows a precisely defined blade holding pocket to be manufactured into the top surface of the blade holder. This provides a highly rigid and durable blade holding means.

U.S. Pat. No. 6,421,923 (the '923 patent), also to Crain Cutter Company, Inc., is a further refinement of the above reference. In this reference the means of constructing the blade holder allows for a more open throat area with fewer obstructions allowing smoother cutting. In addition the blade holder is simpler to manufacture, reducing the cost of the device. This is done in part by spot-welding onto the inner surface of the wall runner a separate metal stamping acting as the support surface or "lip" to hold up the outer edge of the blade. The cost to spot weld on a separate part, rather than to form a support surface into the wall runner itself by means of secondary stamping operations, proves to substantially reduce production cost.

This reference also discloses the top loading blade holder having a retaining blade cover secured by a fastener onto the bolt, similar to the previous reference. In this reference the blade-holding space on the blade holder is made longer overall so that the blades may be more easily inserted. Once the blade is inserted it is simply slid forward into position. When the blade is slid forward a small gap behind the blade on the blade-holding pocket must be filled to securely hold the blade. For this purpose, detents are stamped into the back edge of the blade retaining bracket. These detents are seated in the open area behind the blade. The detents thus define the back edge of a blade holding area and serve to securely hold the blade. In this manner the blade does not need to be fit within a precisely sized blade-retaining pocket, which may be somewhat cumbersome and possibly risk injury from the blade.

This reference also discloses a novel shape for the front edge of the blade holder. This is the location of the tool that bends downward to form on its outside, a wall runner surface, and on its inside, a blade retaining surface. On its top face, the wall runner has a slight upwards bend which creates a small "rise". After the rise there is a substantially flat area. Past this flat area there is the steep downward bend required to form the wall runner surface. The "rise" and "flat" are needed in order to provide clearance for the blade to pass across the throat area and rest flat against the blade support on the inner edge of the wall runner. If there were no "rise", the blade would be met by a curved area formed by the downward bend that creates the wall runner surface. Such a curved area, if located where the blade meets the wall runner, could not provide adequate clearance, with the result that the blade might become angled downward. If the blade is angled downward, it will act as a wedge, causing the tool to be pressed constantly downward. This not only makes the trimming operation inaccurate, but increases the force required to perform it.

This concept of a "rise" followed by a flat area disclosed by the '923 patent also creates a significant labor cost advantage compared to the prior art devices cited heretofore. In the prior art devices the required "rise" was created by a sharp upward bend of the material followed by an immediate downward fold. This folding operation is labor-intensive, and, from a tolerance standpoint, very difficult to control.

As noted in the discussion of prior art references, some means is required for holding the front of the blade on the blade holder within the pocket in which the blade is inserted. The blades used in a carpet trimmer are ground and therefore beveled on only one surface. The beveled surface is meant to face upward when the blade is placed in the trimmer. In operation, the bevel creates a generally downward force. This downward force is counteracted by the blade supporting lip on the inner surface of the wall runner. Thus the upward or downward deflection of the blade is controlled.

In the first two listed references, blade support for the front edge of the blade was formed by secondary stamping operations which create lips on the inner surface of the wall runner. This also added to the difficulty in manufacturing the blade holder to proper position. However in the '923 reference a separate blade-holding support is spot-welded onto the inner surface of the wall runner where the front of the blade rests. This reduces cost of manufacture and greatly speeds up manufacture of the wall runner portion of the tool.

U.S. Pat. Nos. 4,095,341 and 6,421,923 present a number of advantages. However one potential disadvantage is that to adjust the height, one or more spacers is removed from a stack of spacers. Some users have difficulty keeping track of the extra spacers that are not stored on the tool. Thus it is one object of the invention to provide a carpet trimmer that does not require spacers to be taken off of the tool. In addition it is an object of the invention to provide a carpet trimmer that allows visual inspection of the throat width from above.

In addition, it is an object of the invention to provide a faster means of reinserting the blade holder between two shims which does not require a separate locator plate. In addition, it is an object of the invention to provide a means of blade holding on the top side of a blade holder that is designed to be inserted and fastened between two shims.

SUMMARY OF THE INVENTION

The above objects are achieved with a carpet trimmer including a base onto which two posts are secured. An adjustable handle is also mounted on the base. Onto the base a stack of spacers may be positioned. The spacers are secured by a fastener which fastens over each post. Between the spacers is held a blade holder. The blade holder is a generally "L" shaped part having a first top blade holder face, and a second downwardly angled wall runner face. The bottom side of the top blade holder face of this blade holder is designed as "spacer engagement plate", and has two dimples for engaging holes which may be on any one or on all of the spacers. The blade holder has two open-ended slots which may be inserted and retained by the posts. A pair of angled pockets hold the blades. The front of a blade is held on a lip. In one embodiment the top face of the blade carrier has a section that is upwardly angled to create a "rise", followed by a generally flat section, as disclosed by the '923 patent. The pocket holding each blade is slightly longer than the blade itself. Once a blade is inserted into the blade pocket, it is pushed forward against the inner surface of the wall runner where it is supported by the lip. A blade retaining clamp is then positioned over the blade. Each clamp has a detent which may be seated in an open slot at the back of the blade pocket. These open slots are through slots from the top face of the blade holder through to the bottom face. The top face may also include a plurality of parallel lines machined into the part. When the dimples on the bottom of the blade holder are seated properly onto holes in a spacer, any one of these lines will appear parallel with the outer edge of the base, which is easily visible below. These lines thus allow a simplified visual means for determining the throat adjustment and ensuring the blade holder has not been inserted in the spacer stack at a skewed orientation. At least one of the spacers and preferably all of the spacers have a plurality of holes adjacent to each of the posts. These holes are in line and extend from closer to the handle to closer to the front of the tool. A pair of dimples on the underside of the blade holder fits into these holes on a spacer. In this manner, the dimples may be inserted into the holes on the spacer adjusting the throat width of the tool. In the preferred embodiment, holes extend through all of the spacers. Thus a user can look down through the holes in the spacer stack and view the location of the dimples. This provides a second means for visual inspection of the throat width. In addition, a front corner of a spacer, or any other forward face of at least one of the spacers, may be slightly relieved with respect to a spacer above or below, and a section of the tool's blade holder may be made precisely thin enough to fit within the relief in said shim, in order that the blade holder may be inserted or wedged between two shims and thus more easily inserted between the shims. Alternatively, a ledge extending from each shim may be formed in a shim so that a shim may be raised from below. Following this insertion, the fasteners may be tightened and the tool is prepared.

BEST MODE OF CARRYING OUT THE INVENTION

The present invention is a carpet trimmer which allows all spacers on the spacer stack to be stored on the tool. The tool includes two different features for enhanced ability to ensure proper throat width adjustment. Additionally, the tool provides a blade holder with a relieved edge and a set of shims with alternating relieved areas which together provide a faster means of separating shims when reinserting of the blade holder. Additionally, the tool provides blade holders on the top face of the blade holder. A trimmer may incorporate one or many of these features in any number of possible combinations. Either or both features could be used on any individual carpet trimmer. The throat adjustment features allow visual determination from above of proper throat adjustment by a visual indicator. This is advantageous when inserting the blade holder into the tool.

Figures 1, 2:
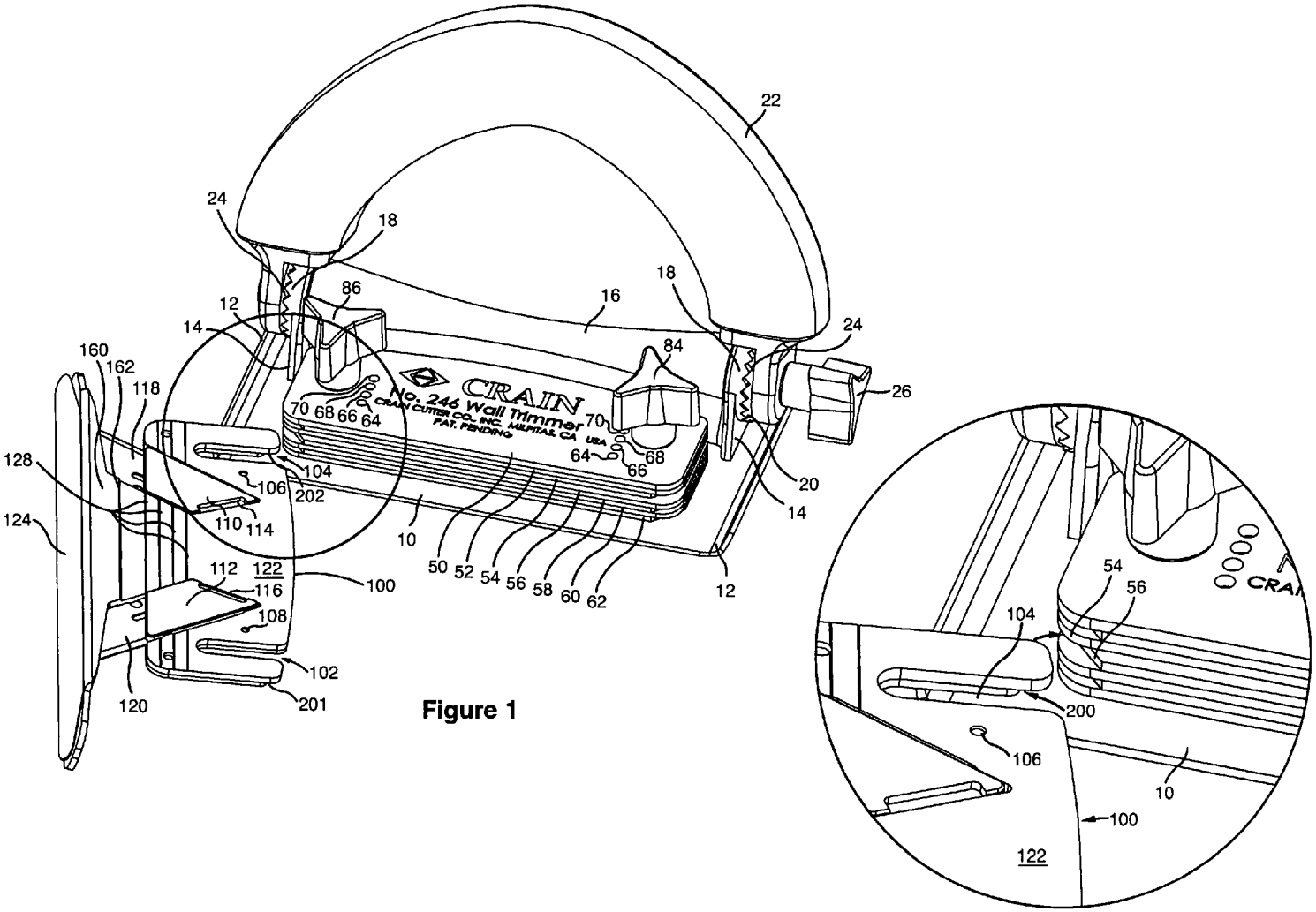
FIG. 1 is a perspective view of the carpet trimmer with the blade holder about to be inserted between two spacers.
FIG. 2 is a detail of FIG. 1 specifically highlighting how a relief in a spacer along with a relief in the back edge of the blade holder may be used to easily separate two shims and insert the blade holder.
Figure 3:
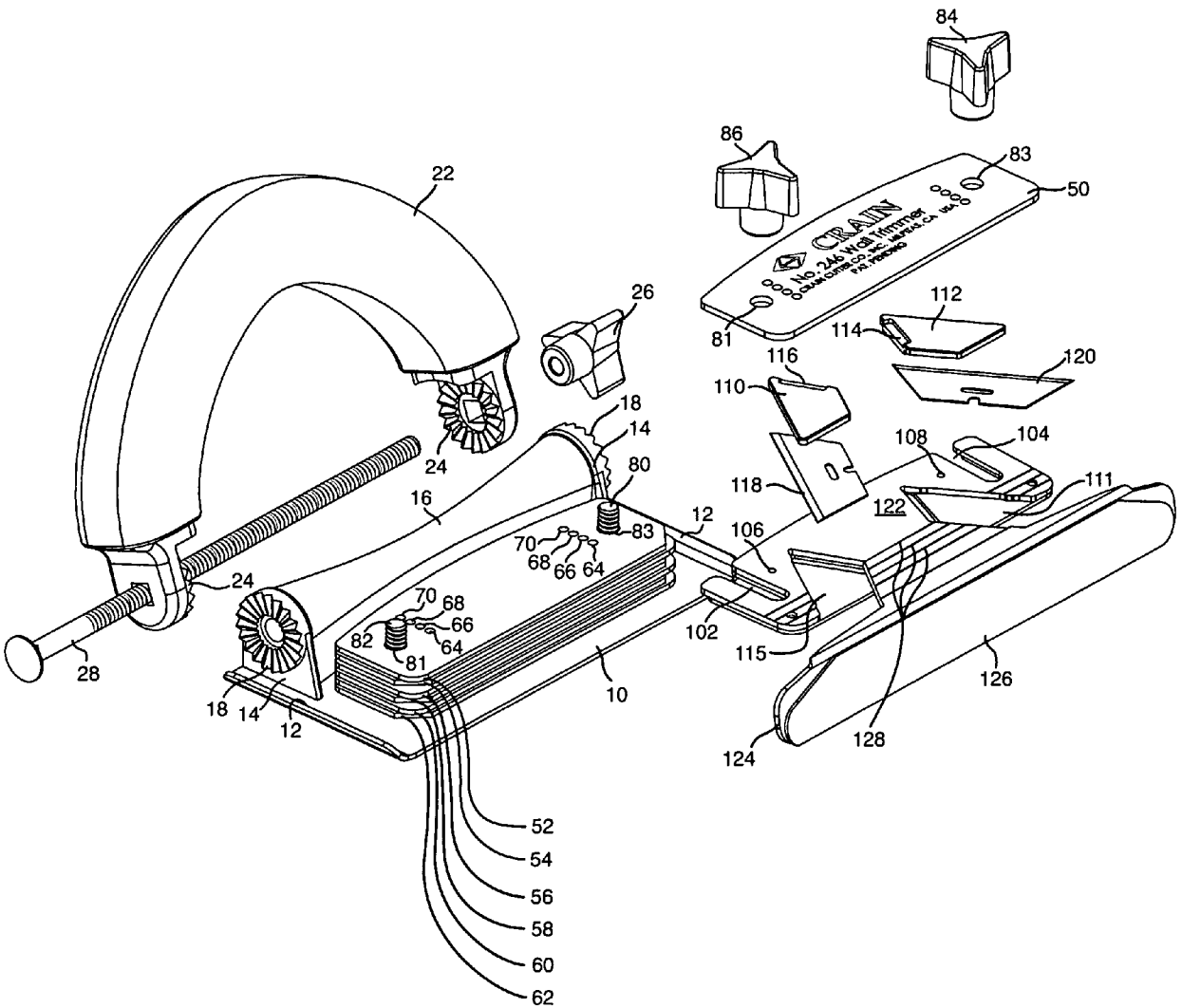
FIG. 3 is an exploded view of the tool.

With reference to FIGS. 1 and 3 the tool includes a base plate 10. This base plate is substantially flat allowing it to be slid over a carpet or floor. Base plate lip 12 on either side of the base plate is upturned. This facilitates plate sliding from side to side. Mounted on base plate 10 are handle mounting brackets 14. These brackets may either be manufactured as part of base plate 10 or simply affixed, as by a screw or bolt, onto the base plate. Extending from handle mounting brackets 14 is bar 16. At either ends of bar 16 is a ratchet surface 18. Hand grip 22 also has a pair of grip ratchet surfaces 24. As shown in FIG. 3 carriage bolt 28 may extend through a hole at the inside of hand grip 22 through bar 16 through a hole on the other end of hand grip 22 and be secured by fastener 26. Fastener 26 is shown as a three-armed knob. This knob allows a user to grip the knob and easily turn the knob. Other fasteners such as cotter pin, clip, or other fastening means may be used. When the fasteners tighten, grip ratchet surface 24 fits against ratchet surface 18 on either side of handle 22 such that the handle is held in a fixed position. This position allows the handle to be substantially parallel to base plate 10, substantially perpendicular to base plate 10, or at another selected angle between parallel and perpendicular. When a carpet is installed in a room having a ledge or installed feature which juts out from a wall, the ability to move the handle to a position substantially parallel to plate 10 allows the tool to be gripped and moved even in locations where there is very little clearance above the tool when cutting. In addition this orientation of the handle allows the tool to be packaged in a rectangular box for display and storage, with the tool taking up a minimum of room. The handle grip 22 may include a rubberized surface. This may be added as a grip tape or may be a cloth or rubber or other polymeric material inserted over the metal handle. The rubberized material may be a tubular sleeve allowing simplified assembly over the metal handle. It may be textured to allow more comfortable gripping and use. The ratcheting handle assembly allows a user to adjust the handle to a comfortable angle for the user.

As shown in FIG. 3, also mounted to base plate 10 are posts 80, 82. Inserted over posts 80, 82 is cover plate 50 and spacers 52, 54, 56, 58, 60, 62. As shown in FIG. 3 each of the cover plate and spacers have a pair of post holes 81, 83 that allow the spacer to be inserted over post 80, 82. Also as shown in FIG. 1 and FIG. 3, one front facing corner of each of spacers 52-62 is relieved. This provides a simplified means of inserting the blade holder as will be explained in relation to FIG. 2. The relieved corners are located on alternating sides relative to the spacer above in the deck such that for each spacer the corner relief on the spacer immediately above will be on an opposite corner. Thus above every relieved corner on each spacer is a ledge formed by the spacer above, which does not have a relieved corner. The positioning of a relief at a corner area of the shim is exemplary. A relieved area could be provided at any area along the front face of the shim in order to be effective. However, the corner area is preferred, as it lies beyond the outer edges of the blade holder, and therefore does not bear any downward pressure from the blade holder. As shown on FIG. 1, fasteners 84, 86 may be attached to the top of posts 80, 82 respectively securing the spacer stack and inserted blade holder fixedly in place.

With reference to FIG. 1, the blade holder 100 includes blade-holder top face 122 and wall-runner surface 124. Blade holder 100 includes slots 102, 104 and dimples 106, 108. Blade holder 100 may be inserted between any of the spacers on the spacer stack. Slots 102, 104 allow posts 80, 82 (FIG. 3) to be received into slots 102, 104. As shown in FIG. 1, dimples 106, 108 extend into holes 64, 66, 68 or 70 on a spacer. In the preferred embodiment all spacers include these holes. The use of four holes is exemplary, fewer or additional holes may be used. The embodiment in which holes extend through every one of the spacers and through cover plate 50 provides a method of visual inspection of throat adjustment position from above. When a user looks down holes 64-70 the dimple may be viewed. This ensures proper throat width adjustment. In one embodiment each of the holes 64-70 may have a letter or number associated with the hole. This would allow a reference number to be used in manuals when instructing on throat width adjustment.

The dimples 106, 108 may project upwards from plate holder top face 122, or may project from the underside of this face. Once blade holder 100 has been inserted between two spacers on the spacer stack such that dimples 106, 108 fit into a hole on a spacer the fasteners on top of the posts are tightened, securing the blade holder fixedly in place. This fixes both the height of the blade on the blade holder and the width of the throat.

FIG. 2 shows the insertion of blade holder 100 into the spacer stack. Relieved area 200 on the corner of the blade holder is being inserted between spacers 54, 56. As shown in FIG. 1, a portion of the bottom face of the blade holder is relieved at corners 201, 202 such that either corner 201 or 202 may easily be inserted within the relief formed at a corner in any of spacers 52, 54, 56, 58, 60, 62. The relieved areas 201, 202 may be formed at any area of the blade holder, but having them on the back side of the blade holder is preferred, as the back edge of the blade holder must enter the spacer deck first. The preferred locations near slots 102, 104 are preferred because they form a narrow point which fits into the relieved corner area quite well. The blade holder may have one or many relieved areas, but at least two are preferred, one on the right side and another on the left. This is because the preferred deck of spacers is relieved in an alternating fashion on either the left or right sides. It is preferred that corner areas 201, 202 are relieved from the bottom face of blade holder 100. However, these relieved areas may be created in the top face of blade holder 100 as well. Once one of the relieved areas 201 or 202 is inserted at a relieved corner area, the spacer above may be lifted, and blade holder 100 may be inserted. As shown on FIG. 3, slots 102, 104 accept posts 80, 82. As shown on FIG. 3, dimples 106, 108 may be seated in a hole on a spacer.

With respect to FIG. 1, blades 118, 120 are held at an angle on blade holder top face 122. The 45 degree angle of the blade causes the blade to cut from the carpet's backing, which prevents the need to shear through all the yarn. It is preferred that this is a 45 degree angle. It has been found that this is an effective angle for intended use of carpet trimming. Each of the blades fits within a blade retaining pocket 111, 115 shown in FIG. 3 on blade holder top face 122. Blade clamps 110, 112 then fit over blades 118, 120. As shown on FIG. 5, the front of the blade rests against the lip formed by the bar 140 which is spot-welded on the inner surface of the wall runner portion 124 or blade holder 100. As shown in FIG. 3, the back part of the blades are secured by blade pockets 111, 115 formed in blade holder top face 122, and clamps 110, 112, respectively. Detents 114, 116 on clamps 110, 112 are secured behind the blade allowing the blade to be pushed forward such that the blade assumes a substantially fixed position. Clamps 110, 112 are of sufficient thickness such that when they are secured over the top face of the blades, the top face of clamps 110, 112 are at a slightly higher elevation than blade holder top face 122. This ensures adequate pressure on clamps 110, 112. Thus, when blade holder 100 is inserted between spacers on the spacer stack, the clamps and blades are held fixedly in place.

Also on blade-holder top face 122 are a plurality of throat adjustment indicating lines 128. This provides another means for ensuring proper throat adjustment. It is preferred that lines 128 and the front of spacers 52-62 both be parallel with the front edge of base plate 10. Thus when the lines are even along the edge of the spacer stack the throat adjustment may be visually determined by viewing from above.

Figure 6:
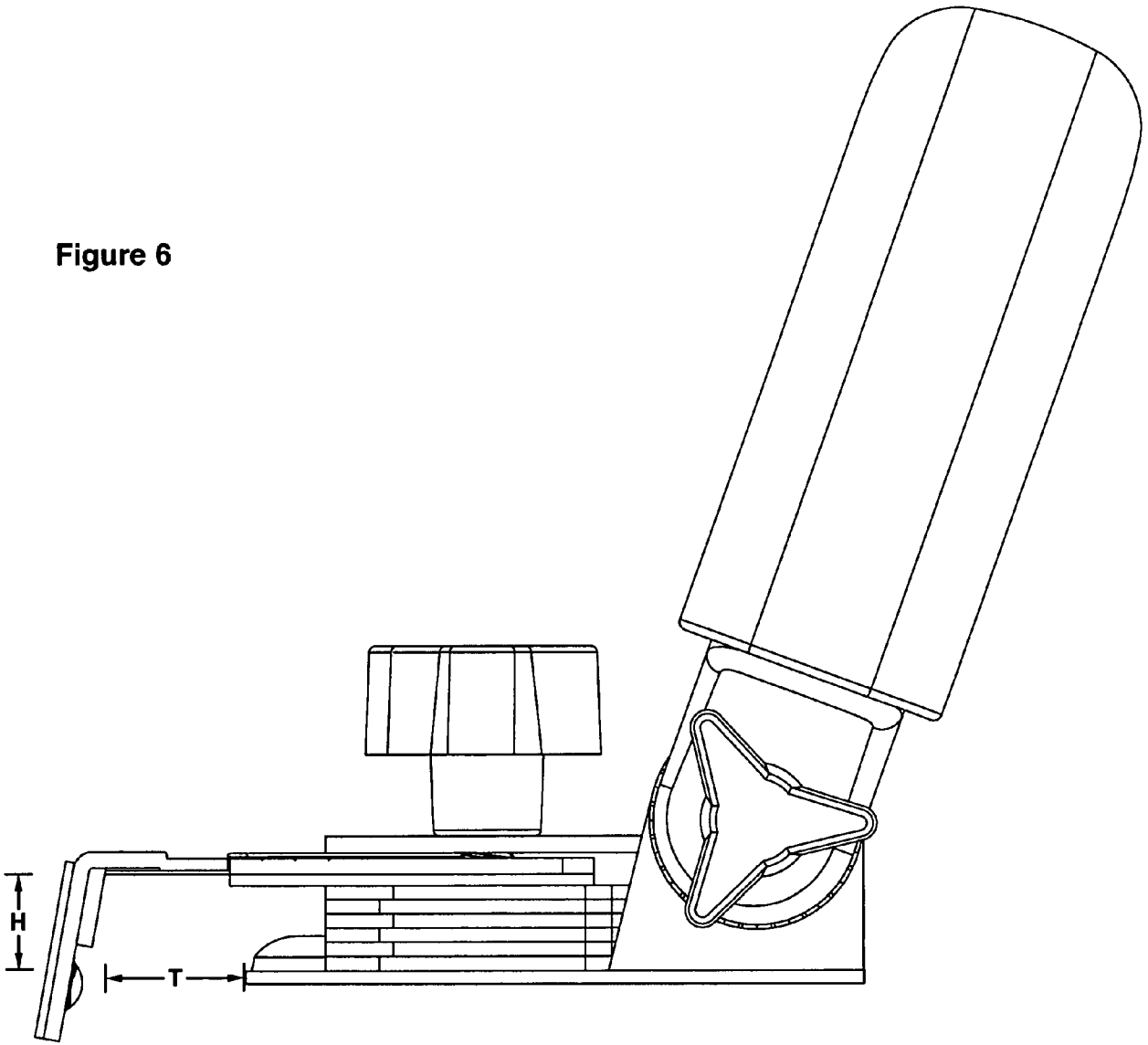
FIG. 6 is a side view of a carpet trimmer showing blade height and throat width.

With reference to FIG. 6, the dimensions of the throat width and the height adjustment are shown. The throat width T, as shown, may vary simply be adjusted by loosening the knobs on the base post and adjusting the blade holder towards the front or the back, depending on whether the throat width needs to be increased or decreased. The height (H) may be simply adjusted by moving the blade holder from the stack and placing the blade holder lower or higher in the stack. Height adjustment thus does not require the removal of spacers.

As shown in FIG. 3, at the front of the blade holder is wall runner surface 124. Affixed to the surface of wall runner surface 124 is a wall protector pad 126. This wall protector pad 126 is a plastic or other similar surface bonded to the front of wall runner surface 124. The wall protector pad 126 may be included in embodiments of the carpet trimmer tool to protect walls from scuffing.

Figure 4:
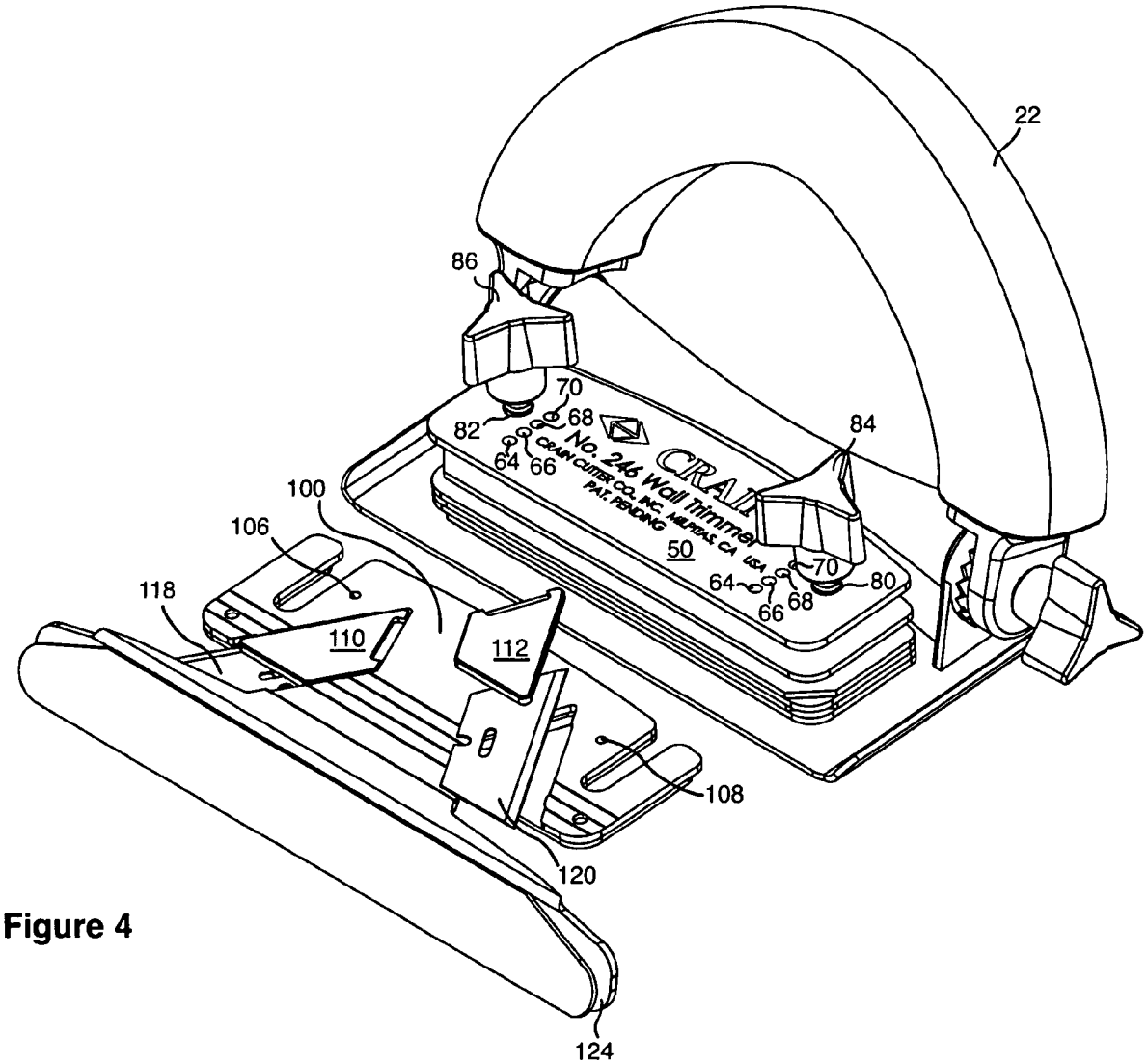
FIG. 4 is a perspective view of the tool showing insertion of a blade and a blade clamp.

With reference to FIG. 4 the simplified manner of blade removal and replacement is shown. Knobs 84, 86 mounted on posts 80, 82 are loosened. In the case of three-armed knobs, the knobs are loosened two to three turns. It is not necessary to remove the knobs. The blade holder 100 may then simply be removed from between two spacers. If the blade holder 100 is inverted both the blades and the clamps will drop free. The replacement blades 120, 118 may then be repositioned on the blade retaining pockets on blade holder 100. The bevelled edge of the blade should be the side facing up. The blade clamps 110, 112 are then reinstalled with the detent on the blade clamp fitting behind the blade. The blade holder may then be reinserted between two spacers on the carpet trimmer. Fasteners 84, 86 are then tightened. The dimples 106, 108 are received in any pair of holes 64, 66, 68, or 70 in a spacer on the spacer stack to adjust the throat width of the device. Once the blades are tightened, a user grips handle 22 to move the device and trim the carpet. The throat width and height have both been selected.

Figure 5:
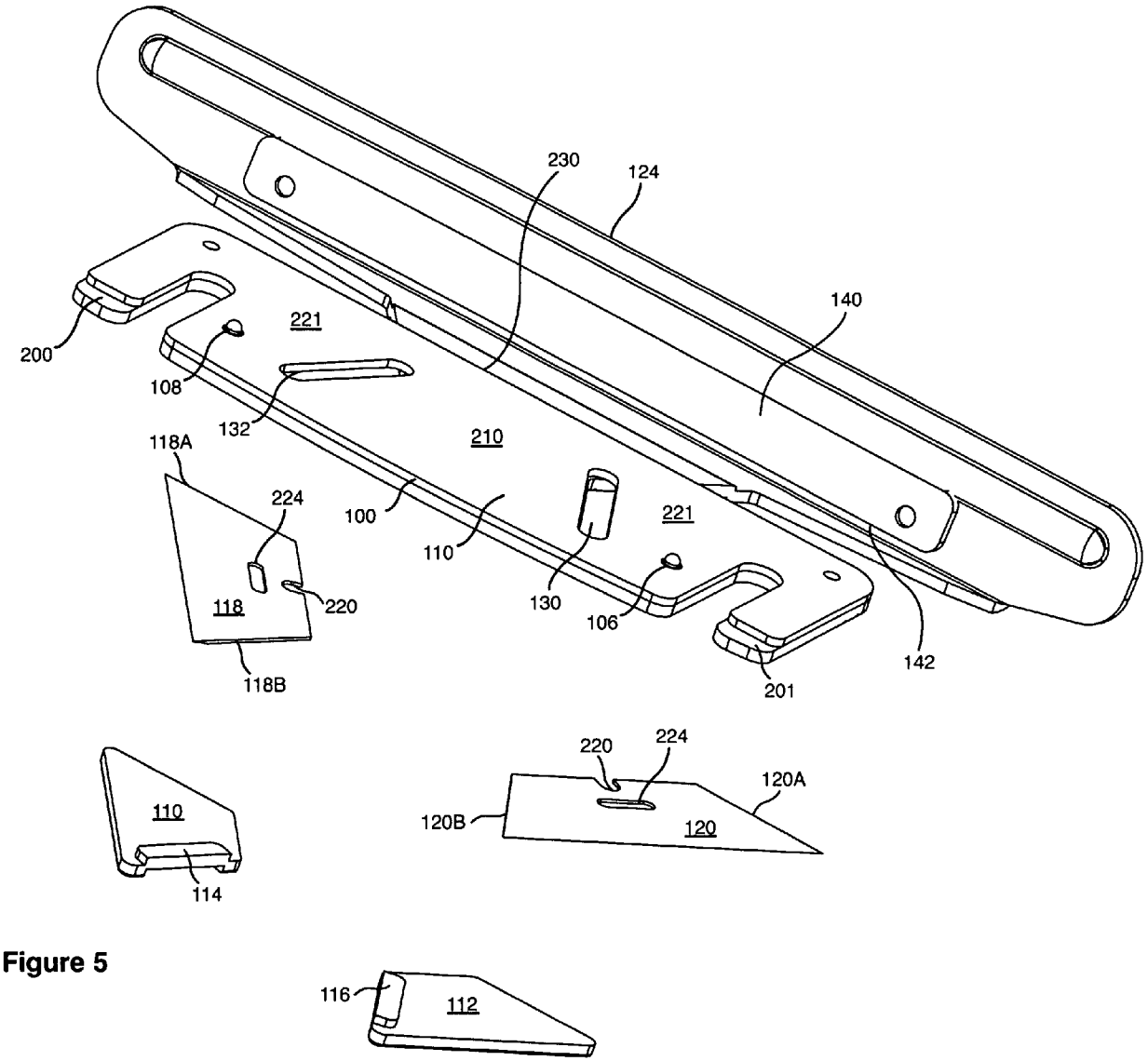
FIG. 5 is a view of the underside of the blade holder.

With respect to FIG. 5, the underside of blade holder 100 is shown illustrating a number of features. In the preferred embodiment, dimples 106, 108 may project from this underside surface. Alternatively, these dimples could project from the top or blade holder face. As explained with relation to the other figures, these dimples may fit into a receiving hole on a spacer in the spacer stack.

Spot-welded onto the inner surface of wall runner 124 is a bar 140. The top of this bar 140 forms lip 142. The front edge 118*a*, 120*a* on blades 118, 120 may rest on lip 142.

In design of the area on the blade holder that transitions from the blade holding face to the wall runner, the bend must be designed so that the front of the blades abut a flat surface. If the metal part is simply bent downwardly at this area, the material will form an inside radius at the location where the blade is meant to rest. This inside radius will contact the blade and will cause it to be angled downward as the user is pushing it forward into its proper location. If the blade is angled downward, it will act as a wedge when cutting, and cause the trimmer to be pressed downward. This will not yield a precision cut, and will require more force. What is needed at the inner surface of the wall runner where the blade meets this inner surface is a more or less vertical wall, not a radius. In a number of different prior devices, this was addressed by creating a first upward 90 degree bend, followed by an immediate 180 degree downward bend, which essentially created a folding of the material. The first upward fold created clearance for the blade, and the second downward fold created a substantially vertical surface where the blade was intended to meet the wall runner. In the preferred embodiment of this invention, as shown in FIG. 1, to form the raised flat area 160, there is a first small "rise" 162. After flat area 160, the metal bends downward at a steep angle to form the wall runner 124. Because of rise 162, the inside radius of wall runner 124 is above the point where the blade will abut the inner surface of wall runner 124. This provides the required substantially vertical surface for the blade to abut. As previously explained, this method of manufacturing the wall runner is less costly than the method of metal folding employed in the devices illustrated in U.S. Pat. Nos. 2,772,474 and 4,095,341.

As shown in FIG. 5, blades 118, 120 are secured by detents 114, 116. Detents 114, 116 on clamps 110, 112 fit into slots 132, 130 respectively and urge the blade forward. This configuration securely holds the blades in place once the blade holder has been inserted into the spacer stack.

The use of a clamp fitting over the blade with a blade recess is preferred. However, a precision blade recess could hold the blade at the desired position and depth, eliminating the need for a clamp with detents. The blade may be held in the blade holding pocket by other alternative methods. For example, one or more bosses may be formed in the blade holding area to engage standard notches 220, or holes 224, which are common to all trimmer blades. The bosses would serve to hold the blade in place. Other bosses supporting the outer edges of the blade may also be employed, rather than a pocket having a perimeter completely encircling the blade. If the dimensions of the blade holding pocket exactly matched the dimensions of the blade (especially in its depth), clamps would not be needed.

Figure 7:
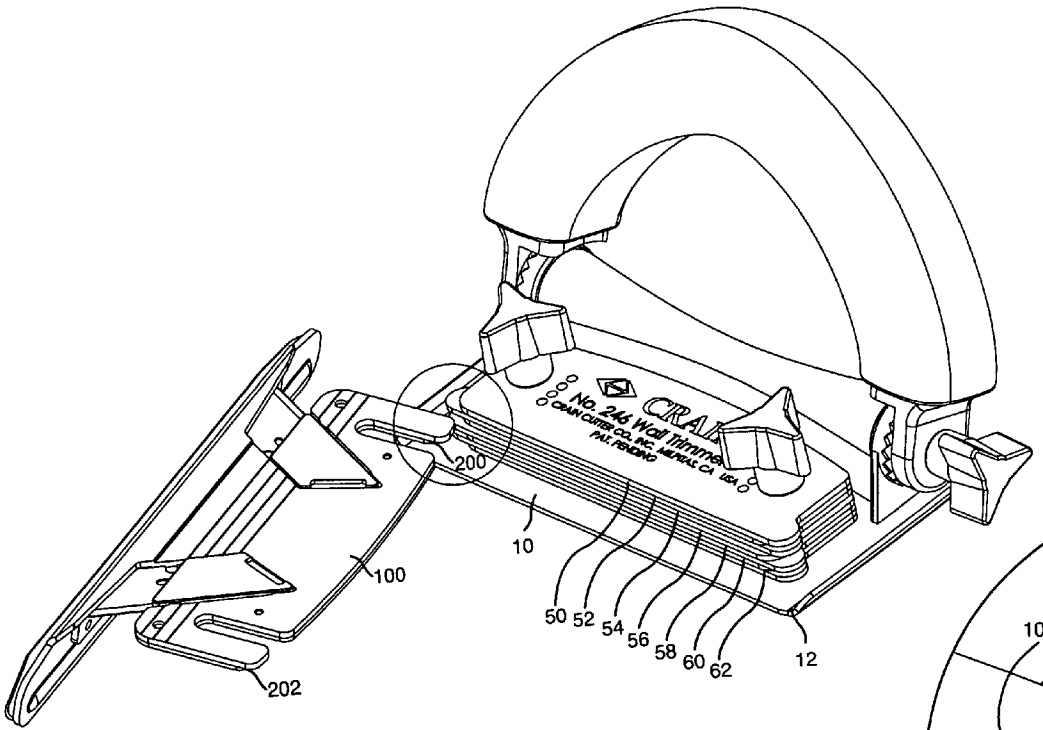
FIG. 7 is a perspective view of an alternative embodiment of this invention with each shim having projections rather than relieved corners. The projections may be used for lifting the shims and inserting the blade holder.

A number of variations in the embodiments are possible. For example it is possible that only one of the spacers would have holes to receive a dimple on the spacer stack. This would require repositioning of all of the spacers on the stack when the height of the blades needed to be changed. For this reason this is a less preferred embodiment. The spacers shown are rectangular and do not have any holes other than the post holes and throat adjustment holes. In other embodiments, the spacers may be oval, diamond, or other shape and additional cutouts of the spacers could be made to reduce tool weight. As shown in FIG. 1, cover plate 50 may include writing including manufacturer part number and patent information. Another embodiment of the invention is shown in FIG. 7. Cover plate 50 and spacers 52, 54, 56, 58, 60, 62 may have a projection rather than a relieved surface at a corner or any other surface, where said projection provides a surface for lifting and separating two shims. A location for the projection near a corner or at some front face of the shim would be preferred. Blade holder 100 would still have relieved areas 200 at each corner to work underneath the projection on a shim, as shown in FIG. 8.

Figure 8:
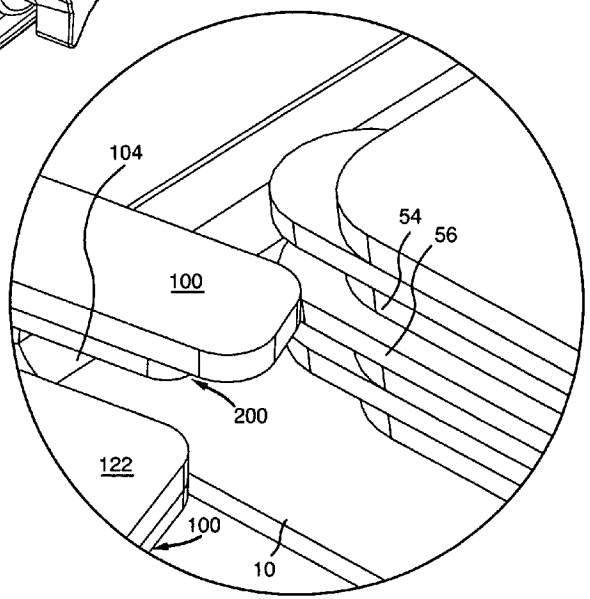
FIG. 8 is a detail of FIG. 7 specifically highlighting how a projection in a spacer along with a relief in the back edge of the blade holder may be used to easily separate two shims and insert the blade holder.

The device of FIG. 1 or FIG. 8 is shown having two blade holding pockets each with an associated clamp. This allows the tool to be used from either direction. The throat adjustment holes that extend through the spacers and cover plate allow viewing of the dimples as they engage or pass by a particular hole in the spacers. This visibility from above helps ensure proper throat adjustment.

Alternatively the lateral lines on the top of the blade holder also allow confirmation of proper throat adjustment. Either or both means may be employed in various embodiments.

This device may be made primarily from stainless steel with a few aluminum castings. The handle grip and wall protector pad may be made of plastic or other similar material. Unlike a '474 device, no separate locator plate is needed because a shim performs the same task. Unlike a '341 or '923 device, no false bottom type assembly is required, as a shim performs the function of throat adjustment. This allows throat adjustment using relatively few parts that are comparatively easy to manufacture.

In the illustrated embodiment of FIG. 1, the device is made primarily of stainless steel parts. Brackets 14, bar 16, and ratchet surfaces 18 are aluminum castings, as is handle 22 and three arm knobs 26, 84, 86. The handle brackets 14, bar 16, and handle 22 are affixed using steel fasteners, and the handle with ratchet surfaces for angular adjustment is attached with a bolt and fastener. The grip handle is made of two parts that are joined by screws (not shown) on opposite sides of the handle. The grip handle is assembled, the hand grip material is affixed over the handle grip, the handle grip is attached to the handle brackets and the brackets are joined to the base plate by screws.

As shown in FIG. 3, the threaded posts 80, 82 are "self clinching" or "press" studs which are a commonly known means of press fitting bolts into holes, such as the holes in base plate 10. The spacers are simple, stamped aluminum parts with holes that fit over the posts. The knobs then attach to threads on the top of the posts.

The blade holder is also a steel part. The blade holding face is made of two steel pieces welded or otherwise attached together. Both pieces have slots in the same location such that when welded together the assembly accepts bolts. As shown in FIG. 5, blade holder 110 has through slots 130, 132 which accept the detents 114, 116 on the blade clamps. The areas 221 on the opposite side of this part form the bottoms of the blade retaining recesses. In addition, the two back corner edges 200, 201, bottom plate 210 is relieved from top plate 110. These create the relieved areas necessary to be inserted into the corner relieved area of the spacer and thereby lift the spacer directly above. These provisions enable faster insertion of the blade holder.

FIG. 5 also shows recess 230 which forms the bottom side of what was referred to as a "rise" with respect to the top face of the blade holder. As noted above, this shape makes the location of the inside radius of the bend forming the wall runner at an elevation that is above the location where the blade is meant to contact the inside surface of the wall runner. Bar 140 is welded to the inner surface of the wall runner to create a supporting lip for the blades. Thus the blade holder is primarily constructed from three stainless steel stampings spot welded together. This process is more economical than forming the same part from two or fewer stampings by means of multiple secondary stamping operations.

A plastic wall runner face guard may then be secured to the front of the wall runner.

We claim:

1. A carpet trimmer tool comprising:

a base plate;

a handle mounted on said base plate;

two posts extending from said base plate;

a plurality of spacers mounted on said posts, at least one of the spacers including a plurality of throat width adjustment holes;

two fasteners securable over the top of each post;

a blade holder including a blade holding face having a top side and a bottom side and a wall runner; at least one blade holding pocket on said top side of blade holding face;

at least one clamp that fits over a blade in one of said blade holding pocket on a top side of said blade holding face, wherein said at least one clamp is configured to be retained on said blade holder by an above positioned spacer;

two grooves on said blade holding face spaced such that said blade holder may be placed between two spacers and said first and second posts are fit into said grooves;

said blade holding face having on either side its top side its bottom side at least two dimples, wherein said dimples may be positioned in two of said throat adjustment holes, thereby providing a means of throat adjustment.

2. The tool of claim 1, wherein each spacer includes a plurality of throat width adjustment holes.

3. The tool of claim 1, further including a plurality of throat width adjustment lines on said blade holding face.

4. The tool of claim 1, wherein said handle includes a mechanism for angular adjustment.

5. The tool of claim 1, wherein said handle includes ratchet adjustment surfaces that allow for angular adjustment.

6. The tool of claim 1, wherein at least one spacer has a relieved area relative to an above spacer, which is not relieved in the same area.

7. The tool of claim 1, wherein alternating spacers have relieved areas relative to an above spacer, which is not relieved in the same area.

8. The tool of claim 1, wherein a bottom spacer has a relieved area in a first location, a spacer above has a relieved area in a second location different from the location of the relieved area on said first spacer, such that the area on the second spacer above the relief in the first spacer is not relieved, with all above spacers alternating in a similar manner.

9. The tool of claim 6, wherein said relief in said spacer is located at a corner surface.

* * * * *